US006446566B1

(12) United States Patent
Bennett et al.

(10) Patent No.: US 6,446,566 B1
(45) Date of Patent: Sep. 10, 2002

(54) YARN FEED FOR ASSEMBLY FOR A TUFTING MACHINE

(75) Inventors: Neale Bennett; Alan Reid; Gary Crossley; Ian Corson, all of Lancashire (GB)

(73) Assignee: Spencer Wright Industries, Inc., Dalton, GA (US)

( * ) Notice: Subject to any disclaimer, the term of this patent is extended or adjusted under 35 U.S.C. 154(b) by 0 days.

(21) Appl. No.: 09/910,123

(22) Filed: Jul. 20, 2001

(30) Foreign Application Priority Data

Nov. 27, 2000 (GB) ..... 0028891

(51) Int. Cl.[7] ..... D05C 15/18; D05C 15/26

(52) U.S. Cl. ..... 112/80.73; 112/475.23

(58) Field of Search ..... 112/80.73, 80.23, 112/80.7, 80.01, 220, 302, 475.23

(56) References Cited

U.S. PATENT DOCUMENTS 6,202,580 B1 * 3/2001 Samilo ..... 112/80.73
6,244,203 B1 * 6/2001 Morgante et al. ..... 112/475.23
6,283,053 B1 * 9/2001 Morgante et al. ..... 112/80.73

FOREIGN PATENT DOCUMENTS

| | | | |
|---|---|---|---|
| EP | 0279580 | 8/1988 | ..... D05C/15/18 |
| FR | 2138476 | 5/1973 | ..... D05C/15/00 |
| GB | 1123540 | 8/1968 | ..... D05C/15/32 |
| GB | 1310039 | 3/1973 | ..... D05C/15/18 |

* cited by examiner

*Primary Examiner*—Peter Nerbun
(74) *Attorney, Agent, or Firm*—Alan Ruderman; Stephen J. Stark; Miller & Martin

(57) ABSTRACT

A tufting machine has a yarn feed roller assembly with a plurality of rotatable driver rollers driven at different speeds and a plurality of actuators in the form of a pivotable arm having in one embodiment a pair of yarn feed reels one of which is arranged to selectively press yarn into engagement with one of the drive rollers and the other arranged to selectively press yarn into engagement with another drive roller. Yarn is engaged by each actuator and a selected drive roller for a period of time determined by a pattern. The longer the actuator engages the high speed roller during the stroke of a tufting machine needle the greater will be the pile height of the tufts produced and alternatively the longer the actuator engages the lower speed roller during the needle stroke the lower will be the pile height. Pile height variations between a high pile and a low pile may be obtained by controlling the proportion of time during the stroke that the yarn engages with the high and low speed rollers.

11 Claims, 4 Drawing Sheets

5
6
7
9
11
12
20
21
22

YARN FEED FOR ASSEMBLY FOR A TUFTING MACHINE

BACKGROUND OF THE INVENTION

The present invention relates to a yarn feed roller assembly for a tufting machine, and also to a method of controlling the pile height of individual stitches in a tufting machine.

U.S. Pat. No. 5,182,997 discloses a yarn feed roller assembly with two longitudinally extending drive rollers, each of which is rotated at a different speed. Associated with each end of yarn is a pivotal arm having a pair of yarn feed wheels each associated with a respective drive roller. A control mechanism is arranged to move the pivotal arm to bring one or other of the feed wheels into contact with a corresponding drive roller so that the yarn is driven by one or other of the drive rollers. When the faster drive roller is used, the yarn feed speed is high thereby tufting a high pile. On the other hand, when the low speed roller is used, the yarn feed speed is reduced and a low pile is tufted. The machine allows the pile height of each individual stitch to be controlled to be either high or low. This individual control is known as a full repeat scroll.

As a development of this, to provide greater patterning flexibility, a machine referred to as a three pile height full repeat scroll has been developed by the applicant. In place of the two drive rollers, this machine uses three drive rollers each of which is driven at a different speed. In a similar way, by selecting with which of the three drive rollers an end of yarn is engaged during a stitch, three different pile heights can be formed.

In order to obtain even greater patterning flexibility, it has been proposed to replace the drive and yarn feed rollers with an individual servo motor for each end of yarn. Thus, instead of three different pile heights, this machine is capable of producing a tufted carpet, in which each stitch has a pile height which can be of any height between maximum and minimum limits. However, this greater flexibility in patterning capability is extremely costly given the number of servo motors required.

SUMMARY OF THE INVENTION

According to the present invention, a yarn feed roller assembly for a tufting machine comprises a first drive roller arranged to be rotatably driven, and a plurality of actuators, each being arranged to bring an end of yarn selectively into driving engagement with the first drive roller; characterized by control means containing pattern data relating to the required pile height of each stitch, the control means being arranged to calculate from this the required proportion of the stroke for which the yarn is required to be driven by the first drive roller to achieve the required pile height, and to control the movement of each actuator so that an end of yarn is driven by the first drive roller for the required proportion of the needle stroke.

This machine provides the same patterning capabilities of continuously variable pile heights that are obtainable with the machine which has a servo motor for each end of yarn. However, it has been estimated that a machine according to the present invention can be produced for significantly less than the cost of the machine with servo motors.

In the broadest sense, the yarn is driven only by the first drive roller and is engaged with this roller for as long as is necessary to generate the required pile height. In this case, the yarn has to be gripped when it is not being driven by the drive roller to prevent the yarn from being dragged into the backing cloth by the needles. However, a preferred option is to provide a second drive roller which is arranged to rotate at a slower speed than the first drive roller, wherein each actuator is arranged to switch an end of yarn such that it is driven either by the first or the second roller to obtain the required pile height. Thus, in order to produce higher pile heights, the actuator will leave the yarn in contact with the first drive roller for a longer proportion of the needle stroke, while to produce lower pile heights, the actuator will leave the yarn in contact with the second drive roller for a longer period. The twin roller arrangement allows the yarn to be fed constantly during the needle stroke, rather than the stop/start motion provided by the single drive roller arrangement. This allows full control of the yarn during the whole needle stroke.

Although the first and second rollers allow any pile height between upper and lower limits to be produced, the invention could be performed with a yarn feed roller assembly having three or more drive rollers all driven at different speeds. The presence of more than two rollers does not allow a greater variety of pile heights to be generated. However, it will have some benefit in that it can reduce the frequency with which the actuator switches between rollers. For example, a yarn feed roller assembly with three drive rollers will be able to produce three different pile heights without having to switch from one roller to another during a needle stroke, it may be that the majority of the carpet can be produced using these three pile heights. Nevertheless, when required, the actuators can switch the yarn from one roller to another during the needle stroke hence producing stitches with intermediate heights.

Each actuator may comprise a pivotable arm having a pair of yarn feed wheels one of which is arranged to selectively press the yarn into engagement with the first drive roller, and the other of which is arranged to selectively press the yarn into engagement with the second drive roller as the arm is pivotally moved. However, preferably, the actuator is provided by an arm having a yarn feed wheel about which the yarn is engaged, and an intermediate wheel which drivingly engages with the yarn feed wheel, the arm being movable such that the intermediate wheel can be selectively brought into driving engagement with either of the first and second drive rollers. Thus, as the yarn engages with the yarn feed wheel and not the intermediate wheel which selectively engages the two drive rollers, the possibility of the yarn being dragged as the intermediate wheel is moved from one drive roller to the other is minimized. As a consequence of this, the clearance between the intermediate wheel and the drive rollers can be reduced, thereby improving the response time of the machine and hence, the accuracy of the pile height.

In an alternative arrangement, the actuator is provided by an arm having a yarn feed wheel, the arm being moveable such that the yarn feed wheel can be selectively brought into driving engagement either with the first or second drive rollers, and means for guiding the yarn around a portion of the yarn feed wheel which does not contact the drive rollers, the yarn feed wheel having a surface which engages with the yarn so as to provide a frictional drive for the yarn. This also provides an arrangement in which the yarn is not fed between the yarn feed wheel and the driver roller.

The present invention also extends to a method of controlling the pile height of individual stitches in a tufting machine comprising, a drive roller arranged to be rotatably driven and a plurality of actuators each being arranged to bring an end of yarn selectively into contact with the drive roller the method comprising the steps of:

determining the required pile height of a particular stitch from pattern data;

determining the proportion of the needle stroke for which the yarn will need to be in contact with the drive roller to achieve the required pile height; and operating the actuator to bring the yarn into contact with the drive roller for the required proportion of the needle stroke.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

In most senses, the tufting machine to which the present invention is applicable has a conventional construction. Thus, a detailed explanation of the workings of the machine will not be provided here.

Figure 1:
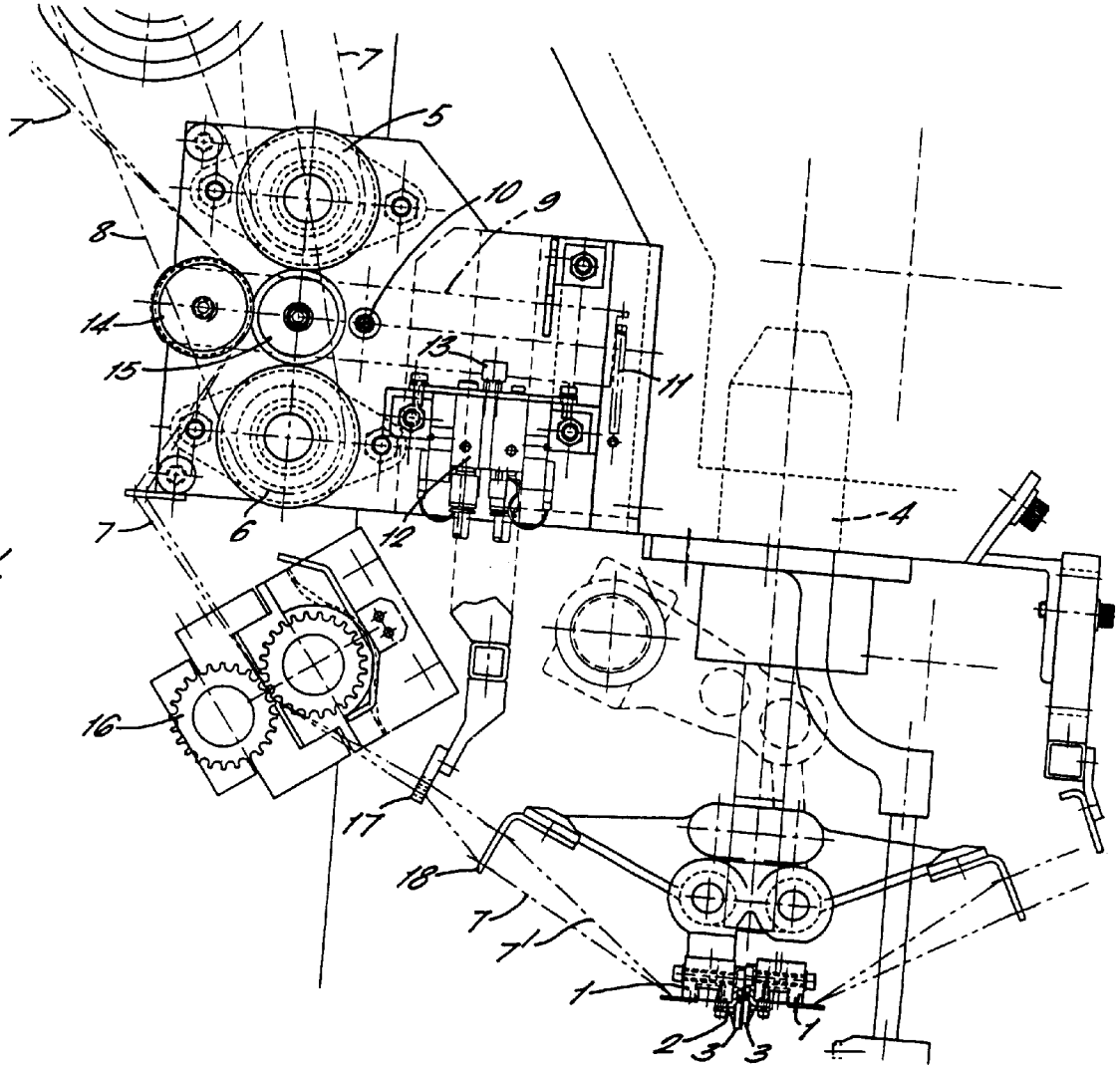
FIG. 1 is a schematic cross-section through a portion of a tufting machine showing the yarn feed roller assembly.

The tufting machine as shown in FIG. 1 has a pair of needle bars 1 to each of which a plurality of needle modules 2 are attached. Each module 2 has a plurality of needles 3. Conventional reciprocating mechanisms 4 are provided to reciprocate both sets of needles.

Each needle bar 1 is fed with the yarn Y from its own separate yarn feed arrangement. In FIG. 1, only the yarn feed arrangement for the left hand needle bar 1 is shown, although it should be appreciated that there is a second identical yarn feed assembly for the right hand needle bar 1. Yarn is fed from a creel (not shown) into the yarn feed roller assembly. Yarn for the adjacent needle 3 to that shown in FIG. 1 follows a slightly different path as indicated at Y' in FIG. 1 as is known in the art.

The yarn feed roller assembly comprises a first drive roller 5 positioned directly above a second drive roller 6. The drive rollers extend longitudinally of the machine and will generally extend the full width of the machine, although two or more drive rollers may be provided end to end to span the full width of the machine. The first drive roller 5 is driven by a belt 7 while the second drive roller 6 is driven by a belt 8 in a known manner. The drive rollers 5, 6 may alternatively be directly driven. The first 5 and second 6 drive rollers are arranged to be driven at different speeds. It is unimportant with this arrangement which is the faster of the two drive rollers.

The mechanism for switching the yarn between the first 5 and second 6 drive roller comprises an arm 9 which is shown in chain lines in FIG. 1, which is pivotally mounted about a fulcrum 10 towards its center. One such arm is provided for each end of yarn to feed the yarn to an individual needle. Thus, there will be a large number of arms and associated mechanisms arranged across the machine. The arm 9 as shown in FIG. 1 is in a position in which its left hand end is in its uppermost position and the right hand end is in the lowermost position. The arm 9 is biased into this position by a spring 11 which is at its minimum length. The arm is movable into its second position by means of a pneumatic actuator 12 which contacts a contact surface 13 to force the right hand end of the arm 9 upwardly against the action of the spring 11. It should be appreciated that the pneumatic actuator can be replaced by an alternative device and may be, for example, piezo electric, electromagnetic or hydraulic.

A yarn feed wheel 14 is provided at the left hand extremity of the arm 9. An intermediate wheel 15 positioned between the drive rollers 5, 6 and in close engagement with the yarn feed wheel 14. The outer surfaces of the yarn feed wheel 14 and intermediate wheel 15 are made of polyurethane rubber. Yarn feed wheel 14 is spring loaded so that it can be moved away from the intermediate wheel 15 to allow the yarn Y to be threaded round the yard feed wheel 14. The yarn feed wheel is then returned to its operating position to nip the yarn between the yarn feed wheel 14 and intermediate wheel 15. Thus the yarn is driven upon the rotation of these two wheels. In the position shown in FIG. 1, the left hand end of the arm 9 is in its uppermost position, in which the intermediate wheel 15 engages with the first drive roller 5, such that the yarn Y is driven at a speed determined by the first drive roller 5. When the pneumatic actuator 12 is actuated, the left hand end of the arm 9 is moved downwardly bringing the intermediate wheel 15 into engagement with the lower drive roller 6, hence driving the yarn Y at a speed determined by the second drive roller 6.

Upon leaving the yarn feed roller assembly, the yarn Y is fed through a pair of gear-type puller rolls 16 which brush against the yarn, rather than driving it, and serve to maintain the tension in the yarn while isolating the yarn feed assembly from variations in the yarn tension caused by a reciprocation of the needles 3. The yarn then extends through a pair of guide plates 17, 18 and then to the needles 3.

The way in which the machine is controlled in order to produce the various pile heights, will now be described with reference to FIG. 2.

The tufting machine is provided with pattern data which contains information on the required height of each stitch of the pattern. A control means receives this-data and controls the timing of actuation of the pneumatic actuator 12 accordingly.

In the following explanation, the roller 5 is the high speed roller, while the roller 6 is the low speed roller.

In order to tuft a carpet at the full pile height as shown in FIG. 2(A), the arm 9 is in engagement with the high speed roller 5 at the start of the needle stroke and remains in engagement with this roller throughout the stroke. Thus, at all times, the yarn is being fed at the fastest rate and therefore tufts at the maximum pile height (in this case 20.0 mm).

On the other hand, a carpet tufted at the lowest possible pile height is shown in FIG. 2(F). In this case, the arm 9 is in contact with the low speed roller 6 at the start of the needle stroke and throughout the stroke. Thus, at all times, the yarn Y is fed at the lowest rate hence, tufting at the lowest possible pile height (in this case, 4.0 mm). FIGS. 2(B), to 2(E) show four intermediate stages between these two extremes. The height of the pile is determined by the point during the needle stroke when the yarn switches from being driven by one of the drive rollers to the other. Thus, in FIG. 2(B), the control means operates to maintain the intermediate roller 9 in contact with the high speed roller 5 for 80% of the needle stroke, and switches for 20% of the needle stroke to the low speed roller 6. In FIGS. 2(C) to 2(E), the portion of the time spent driving the yarn Y with the high speed roller 5 is decreased from 60% to 40% to 20% respectively, while the portion of the stroke spent driving the yarn Y with the low speed roller 6 is increased from 40% to 60% to 80% respectively.

Figure 2:
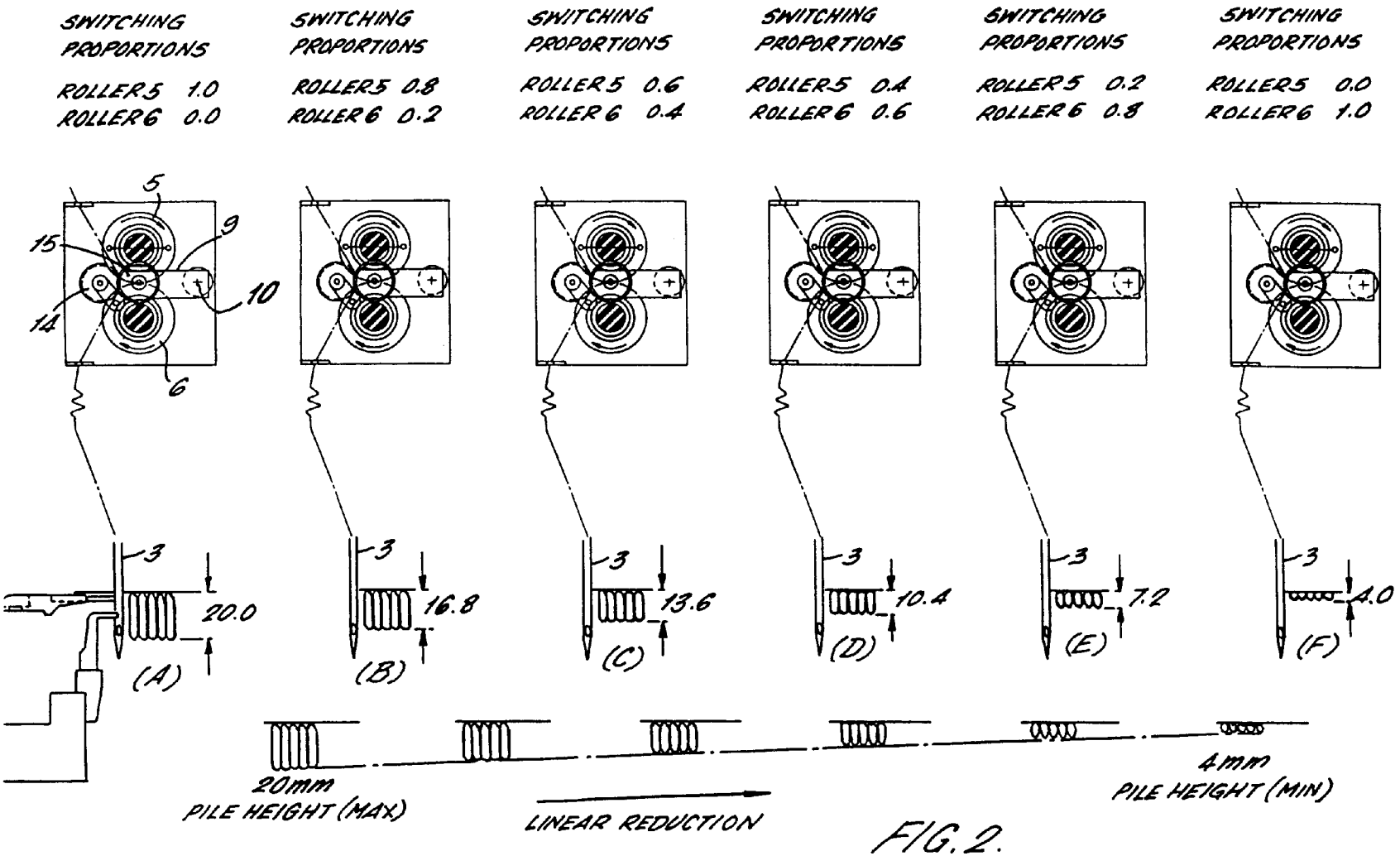
FIG. 2 is a number of diagrams (A)–(F) which show various pile heights that can be formed by the tufting machine.

In theory, it is possible to produce a pile height at any value between the two extremes as is shown towards the bottom of FIG. 2. However, in practice, it may be sufficient to be able to produce a number of different discrete pile heights such as the six shown in FIGS. 2(A) to 2(F). In practice, it is believed that between 5 and 7 different pile heights will be sufficient for most purposes.

As mentioned above, the intermediate roller 15 is moved between the high speed 5 and low speed 6 rollers. Optimum performance is achieved if this movement is done only once per needle stroke. However, there is no reason why this should not be done any greater number of times. Also, the control could be set such that the intermediate wheel 15 is moved into a default position in contact with one or other of the rollers 5, 6 at the beginning of each stroke. However, it is preferable for a stroke of each needle to begin with the intermediate wheel 15 in the position that it was in at the end of the previous needle stroke. In particular, if the pattern data requires a number of stitches at either the maximum or the minimum pile height, there is no need to move the intermediate wheel 15 at all while these stitches are being formed.

Figure 3:
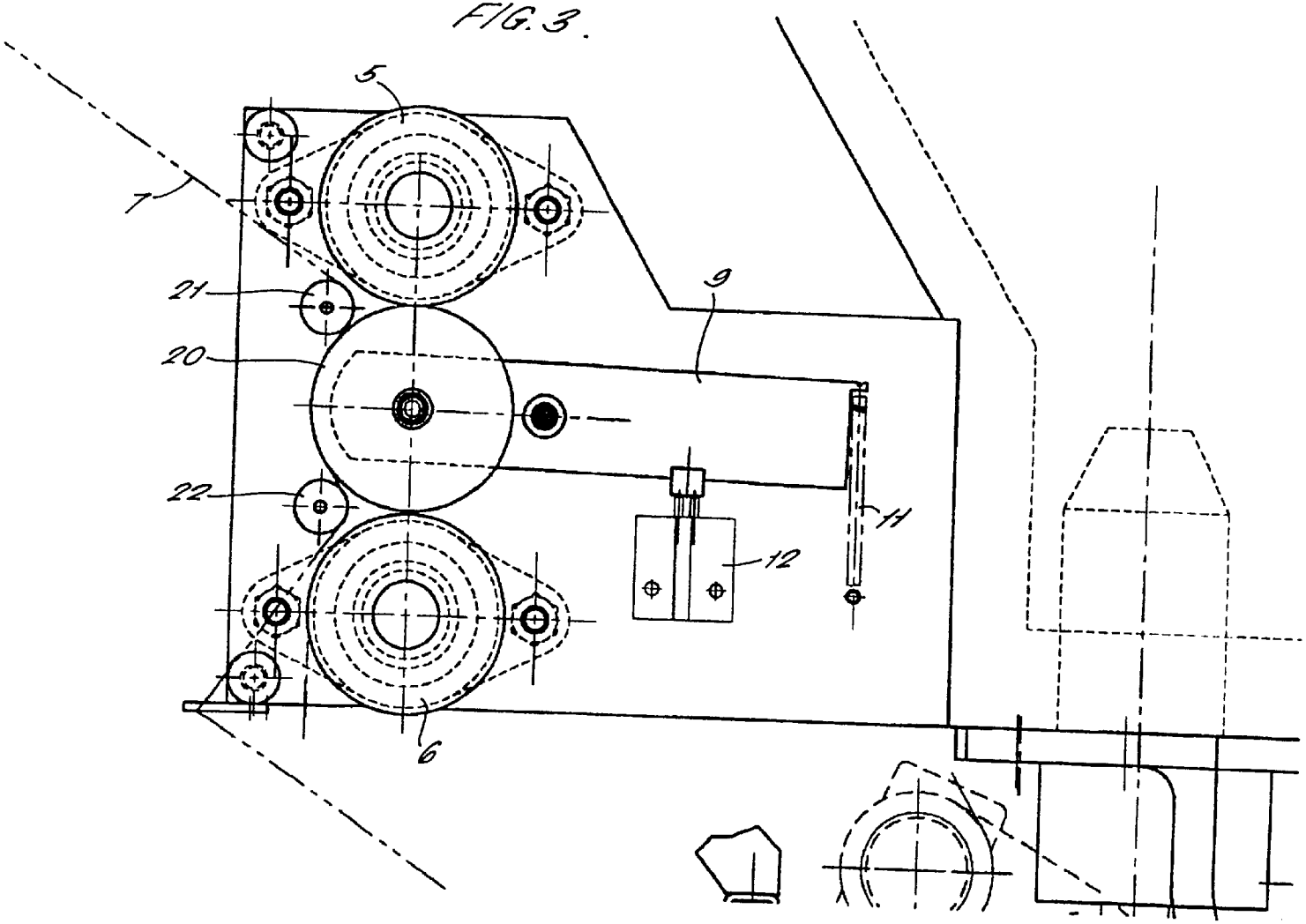
FIG. 3 is a schematic cross-section showing an alternative actuator mechanism to that shown in FIG. 1.

An alternative actuator mechanism for switching between the two drive rollers 5, 6 is shown in FIG. 3. In this example, most of the assembly is as shown in FIG. 1 including the drive rollers 5, 6 and the spring 11 and pneumatic actuator 12. However, in FIG. 3, the yarn feed wheel 14 and intermediate wheel 15 have been replaced by a single yarn feed wheel 20 and upper 21 and lower 22 fixed yarn guide bars. The yarn Y is fed between the upper yarn guide bar 21 and the yarn feed wheel 20 around the yarn feed wheel 20 and then between lower yarn guide bar 22 and yarn feed wheel 20. The yarn feed wheel 20 has a grit surface which provides a frictional drive for the yarn. In common with FIG. 1, the yarn Y is not fed through the gap between the yarn feed wheel 20 and either of the driver rollers 5, 6. In FIG. 3, the yarn feed wheel 20 is in its uppermost position. In this position, the yarn feed wheel 20 is driven by the first drive roller 5. In the lowermost position, the yarn feed wheel 20 is driven by the second drive roller 6. Thus, this arrangement can be used to generate the same patterning effects as shown in FIG. 2. However, as the movement of the arm 9 opens and closes the gap between the yarn feed wheel 20 and the two yarn guide bars 21, 22, there is no need to provide a spring loaded arrangement as is required of the yarn feed wheel 14 in FIG. 1 as the yarn Y can be fed through the arrangement shown in FIG. 3 simply by moving the arm 9.

Figure 4:
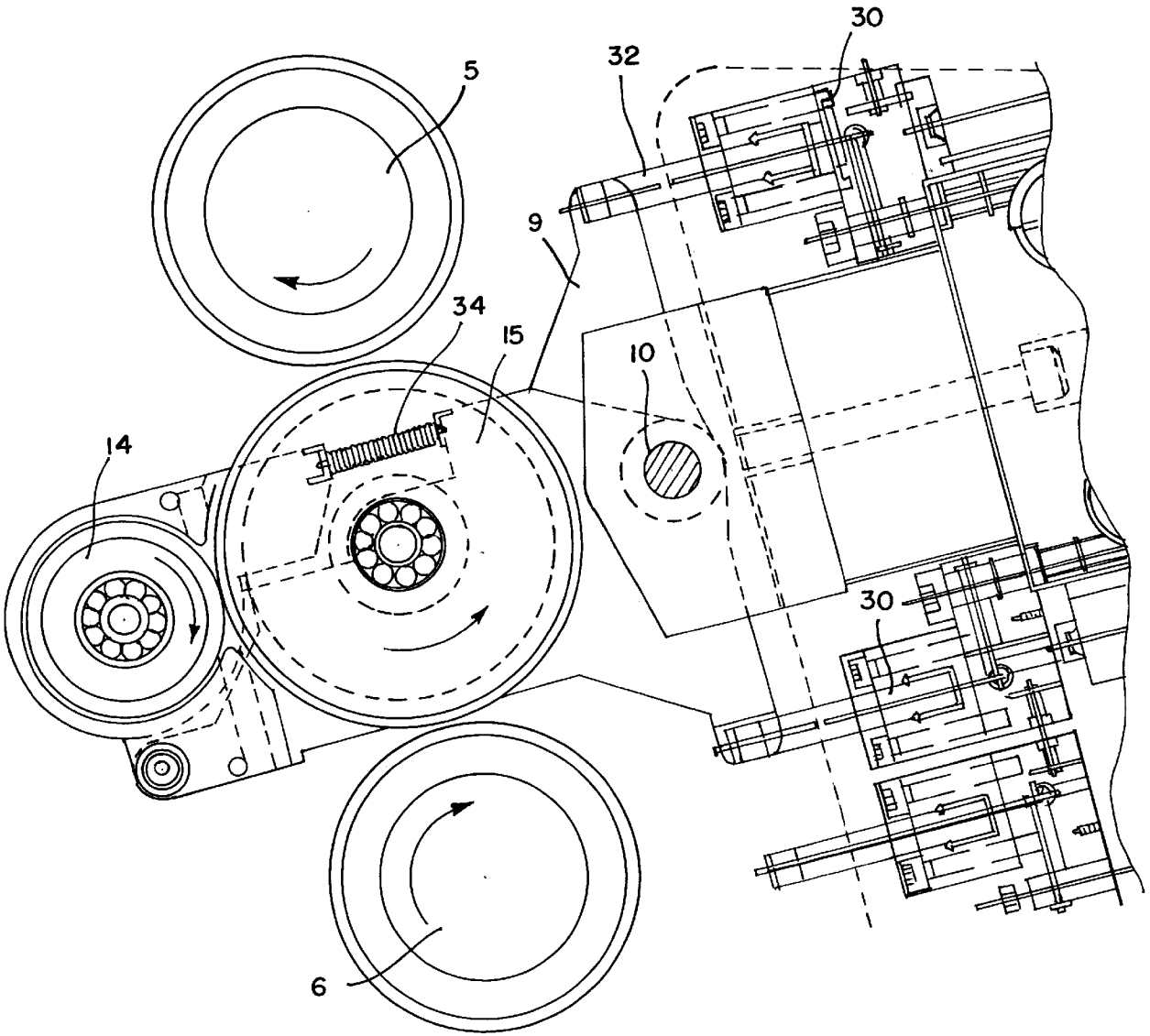
FIG. 4 is a schematic cross-section showing a presently preferred actuator mechanism to replace that shown in FIG. 1.

FIG. 4 shows the presently preferred mechanism for the activator used to switch the yarn Y between the first 5 and second 6 drive roller. The arm 9 is moved by electric, or servo motors 30, about the pivot or fulcrum 10. The servo motors 30 drive pistons 32 connected to the arm to move the arm 9 about the fulcrum 10 to move the intermediate wheel 15 to contact one of the first 5 or second 6 drive rollers. The yarn feed roll 14 is illustrated as spring loaded by spring 34 in this embodiment.

Numerous alternations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A yarn feed roller assembly for a tufting machine comprising a first drive roller arranged to be rotatably driven, and a plurality of actuators, each being arranged to bring an end of yarn selectively into driving engagement with the first drive roller; characterized by control means containing pattern data relating to the required pile height of each stitch, the control means being arranged to calculate from this the required proportion of a needle stroke for which the yarn is required to be driven by the first drive roller to achieve the required pile height, and to control the movement of each actuator so that an end of yarn is driven by the first drive roller for the required proportion of the needle stroke.

2. A yarn feed roller assembly according to claim 1 further comprising a second drive roller arranged to rotate at a slower speed than the first drive roller, wherein each actuator is arranged to switch an end of yarn such that it is driven either by the first or the second roller to obtain the required pile height.

3. A yarn feed roller assembly according to claim 2, comprising three or more drive rollers all arranged to rotate at different speeds, wherein each actuator is arranged to switch an end of yarn such that it is driven by any of the drive rollers.

4. A yarn feed roller assembly according to claim 2 wherein the actuator is provided by an arm having a yarn feed wheel about which the yarn is engaged, and an intermediate wheel which drivingly engages with the yarn feed wheel, the arm being movable such that the intermediate wheel can be selectively brought into driving engagement with either of the first and second drive rollers.

5. A yarn feed roller assembly according to claim 1 wherein the actuator is provided by an arm having a yarn feed wheel about which the yarn is engaged, and an intermediate wheel which drivingly engages with the yarn feed wheel, the arm being movable such that the intermediate wheel can be selectively brought into driving engagement with the first drive roller.

6. A yarn feed roller assembly according to claim 2 wherein the actuator is provided by an arm having a yarn feed wheel, the arm being moveable such that the yarn feed wheel can be selectively brought into driving engagement either with the first or second drive rollers, and means for guiding the yarn around a portion of the yarn feed wheel which does not contact the drive rollers, the yarn feed wheel having a surface which engages with the yarn so as to provide a frictional drive for the yarn.

7. A method of controlling the pile height of individual stitches in a tufting machine comprising a drive roller arranged to be rotatably driven, and a plurality of actuators each being arranged to bring an end of yarn selectively into contact with the drive roller, the method comprising the steps of:

determining the required pile height of a particular stitch from pattern data;

determining the proportion of a needle stroke for which the yarn will need to be in contact with the drive roller to achieve the required pile height; and operating the actuator to bring the yarn into contact with the drive roller for the required proportion of the needle stroke.

8. A yarn feed roll assembly for use with a tufting machine, said yarn feed roll assembly comprising:

a first drive roller rotatably driven at a first speed;

a plurality of actuators, each of said actuators adapted to selectively feed a yarn for a programmed pile height during a stroke of a needle, said programmed pole height being selected from at least a higher and a lower pile height, said plurality of actuators configured to engage and disengage said first drive roller during the needle stroke to achieve the programmed pile height.

9. A yarn feed roll assembly for use with a tufting machine, said yarn feed roll assembly comprising:

a first drive roller rotatably driven at a first speed;

a second drive roller rotatably driven at a second speed;

a plurality of actuators, each of said actuators adapted to selectively feed a yarn for a programmed pile height during a stroke of a needle, said plurality of actuators configured to engage and disengage said first drive roller during the needle stroke to achieve the programmed pile height, and wherein said plurality of actuators are configured to engage and disengage said second drive roller during the needle stroke.

10. The yarn feed roll assembly of claim 8 wherein the plurality of actuators further comprises:

an intermediate wheel moveable between an engaged and a disengaged position relative to the first drive roller;

a yarn feed wheel drivingly engaged to the intermediate wheel; and wherein the yarn is driven by the yarn feed wheel when the intermediate wheel is drivingly engaged by the first drive roller.

11. The yarn feed roll assembly of claim 9 wherein the plurality of actuators further comprises:

an intermediate wheel moveable between an engaged and a disengaged position relative to the first drive roller, and an engaged and disengaged position relative to the second drive roller;

a yarn feed wheel drivingly engaged to the intermediate wheel; and wherein the yarn is driven by the yarn feed wheel when the intermediate wheel is drivingly engaged by one of the first and second drive rollers.

* * * * *